US005207721A

United States Patent [19]

Lobdell

[11] Patent Number: 5,207,721

[45] Date of Patent: May 4, 1993

[54] PUTTER

[76] Inventor: Thomas Lobdell, 1411 Summit Ct., Mukwonago, Wis. 53149

[21] Appl. No.: 895,619

[22] Filed: Jun. 9, 1992

[51] Int. Cl.[5] ..... A63B 69/36

[52] U.S. Cl. ..... 273/186.2; 273/129 M; 273/167 C; 273/167 J; 273/175; 273/174; 273/193 R

[58] Field of Search ..... 273/193 R, 193 A, 193 B, 273/194 R, 194 A, 194 B, 187.4, 186.2, 175, 129 M, 174, 172, 162 R, 192, 167 C, 167 J, 167 A, 167 B, 167 C, 77 R

[56] References Cited

U.S. PATENT DOCUMENTS

| | | | |
|---|---|---|---|
| 2,300,043 | 10/1942 | Carney | 273/174 |
| 3,049,833 | 8/1962 | Felsch | 273/167 A |
| 3,220,730 | 11/1965 | Fine | 273/167 A X |
| 3,319,964 | 5/1967 | Steinberg | 273/194 |
| 3,394,937 | 7/1968 | Allport | 273/175 |
| 3,430,963 | 3/1969 | Wozniak et al. | 273/175 X |
| 4,688,799 | 8/1987 | Johnson | 273/192 |

FOREIGN PATENT DOCUMENTS

| | | | |
|---|---|---|---|
| 14733 | of 1900 | United Kingdom | 273/129 M |

*Primary Examiner*—George J. Marlo
*Attorney, Agent, or Firm*—Andrus, Sceales, Starke & Sawall

[57] ABSTRACT

A golf putter includes an elongated head having an axle adapted for supporting a pair of coaxial rotatable wheels. The putter is rolled along the wheels in the direction of a sight line to strike and direct the golf ball. The strike surface of the putter is convex to assure proper relative position between the ball and the strike surface regardless of the angular position of the putter. The wheels have a resilient outer covering to protect the putting surface and to assure that the wheels grip the putting surface and roll rather than slide as the putter is advanced.

11 Claims, 1 Drawing Sheet

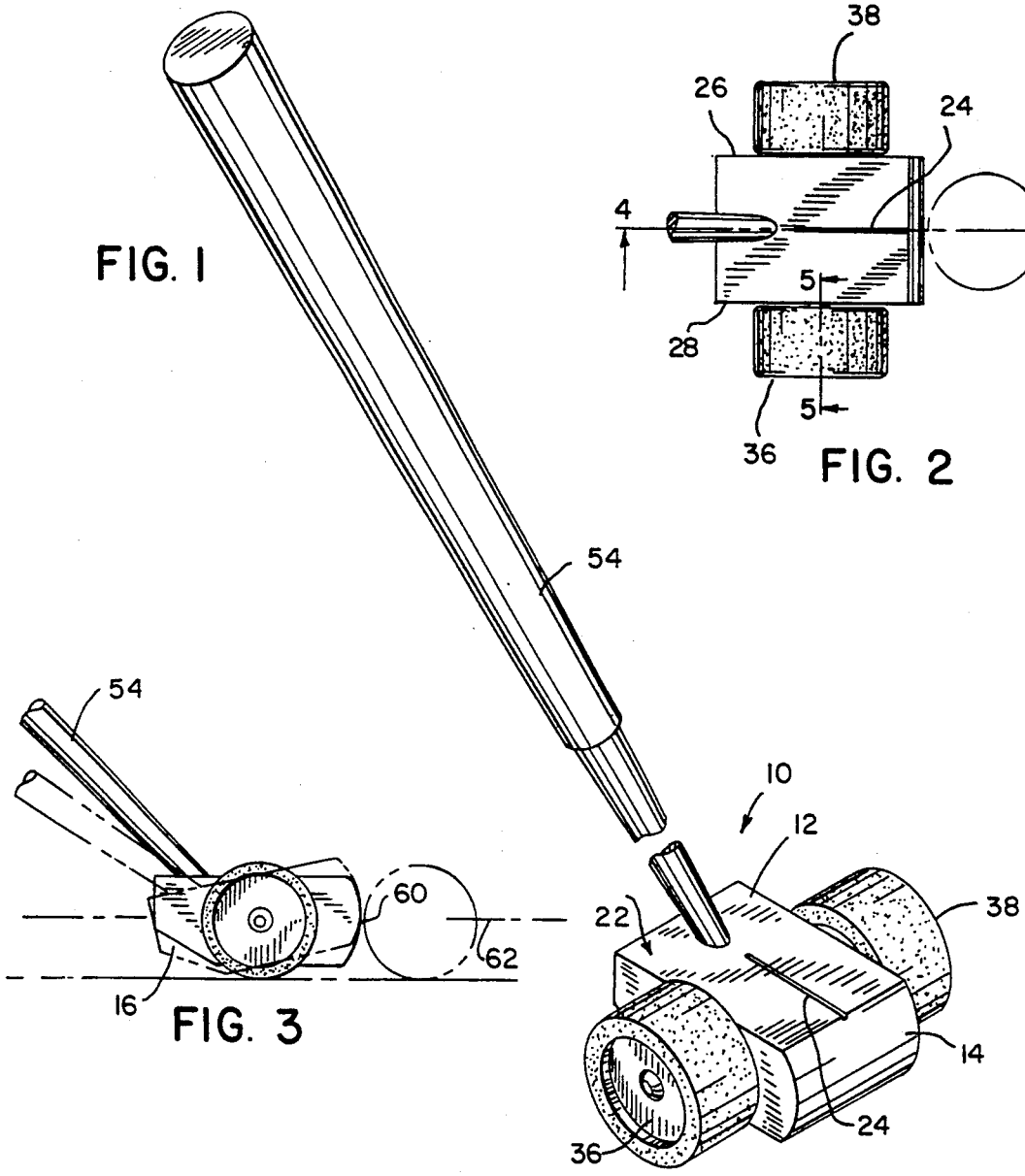
FIG. 1
FIG. 3
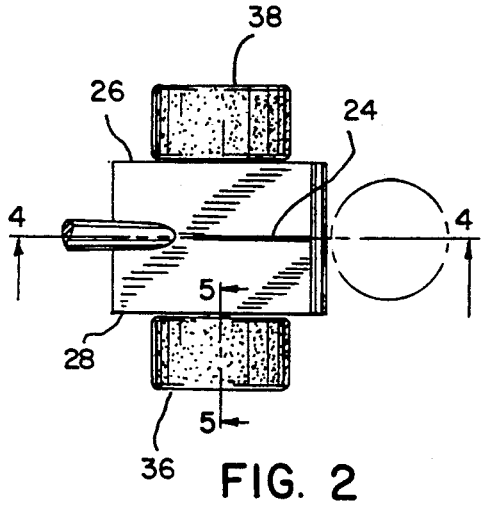
FIG. 2
FIG. 5
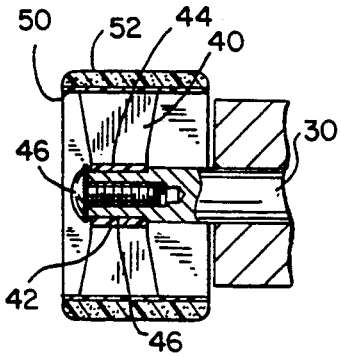
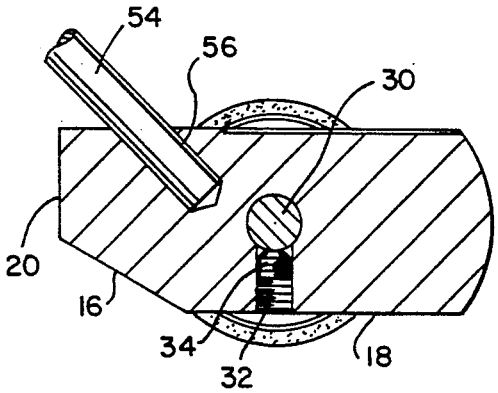
FIG. 4

PUTTER

BACKGROUND OF THE INVENTION

1. Field of the Invention

This invention is generally related to golf equipment and is specifically related to a new and improved putter.

2. Description of the Prior Art

Novelty devices for advancing object balls are well known. For example, British Patent 14,733 for "Improvements in Lawn or Floor Billiards, Croquet and similar Games", issued on Dec. 15, 1900 shows a device having wheels on either side of the head for pushing a ball when a force is exerted against the shaft. U.S. Pat. No. 3,220,730, entitled "Golf Putter with Wheel Supported Head" and issued to J. A. Fine on Nov. 30, 1965 shows a putter having wheels on either side of the head in a substantially horizontal shaft.

However, neither of these devices is well suited as a training tool or putter for achieving accuracy of aim and stroke force during putting in a golf game. For example, the Fine patent requires that the shaft be positioned horizontally relative to the putting surface. This would require that the user be on his hands and knees, and has no translatable value in developing techniques for increasing accuracy of aim and stroke force when in a standing position.

The British Patent is deficient in that it does not assist in sighting the aim of the putter. Further, the smooth surface on the wheels, would allow the device to slide across a putting or stroking surface, rather than roll, diminishing the value of the wheeled head.

Other patents generally related to the subject invention are as follows: U.S. Pat. No. 2,300,043, entitled "Golf Club", issued to G. Carney on Oct. 27, 1942; U.S. Pat. No. 3,319,964, entitled Practice Golf Club", issued to W. F. Steinberg on May 16, 1967 and U.S. Pat. No. 4,688,799, entitled "Golf Club", issued to K. W. Johnson on Aug. 25, 1987.

SUMMARY OF THE INVENTION

The subject invention is specifically directed to a putter adapted to be pushed into the golf ball by rolling the putter on a pair of coaxial wheels which are orthogonal to the direction of movement of the putter. The putter is ideal for use as a training tool for teaching people the theory behind force and direction when putting and has been found to be particularly useful in improving accuracy of both aim and distance. The putter is also ideally suited for people who still enjoy to play golf but are no longer able because of certain incapacities. For example, the putter may be used from a wheelchair, permitting a handicaped individual to still enjoy certain aspects of the game of golf.

In the preferred embodiment of the invention, the putter comprises a head having an axle for rotatably supporting a pair of wheels which are adapted to turn when the head is pushed in the proper direction, allowing the putter to roll into and strike the ball for advancing it toward a hole. In the preferred embodiment, the putter includes a sight line for facilitating proper positioning of the putter relative to the ball and for aiming the stroke of the putter to properly strike the ball. The shaft extends upwardly from the head at an acute angle, permitting the putter to be used from both a standing position and a sitting position.

The front of the head includes a surface which is on a convex radius, assuring that the putter will strike the center line of the ball regardless of the angular position of the putter relative to the head, further facilitating use of the putter from a variety of positions.

In the preferred embodiment, the wheels have a resilient outer rim, assuring that the putter rolls, rather than slides across a surface and assuring that the putter does not injure fragile blades of grass commonly found on well groomed golf greens.

It is, therefore, an object and feature of the subject invention to provide a putter adapted for pushing a ball by rolling the putter along a pair of coaxial wheels.

It is a further object and feature of the invention to provide a putter which is adapted for use from both a sitting and standing position.

It is yet another object and feature of the subject invention to provide a putter which is ideally suited for use as a training tool for improving both aim and distance when putting.

It is a further object and feature of the invention to assure that the putter always properly strikes the ball along its center line independently of the angular position of the putter relative to the ball.

Other objects and features of the invention will be readily examined from the accompanying drawing and description.

BRIEF DESCRIPTION OF THE DRAWINGS

The drawings illustrate the best mode presently contemplated of carrying out the invention.

In the drawings:

FIG. 1 is a perspective view of the putter in accordance with the subject invention.

FIG. 2 is a plan view of the top of the putter of FIG. 1.

FIG. 3 is a side view of the putter of FIG. 1, showing the angular position of the putter relative to the ball.

FIG. 4 is a sectional view of the putter taken generally along the line 4—4 of FIG. 2.

FIG. 5 is a partial section view of the putter taken generally along the line 5—5 of FIG. 2.

DETAILED DESCRIPTION OF THE PREFERRED EMBODIMENT

The golf putter 10 of the subject invention is shown in perspective in FIG. 1 and includes a head 12 having a generally rectangular shape. The front surface is a convex striking surface 14. The rear edge 16 is beveled between the bottom surface 18 and the rear surface 20 (see FIG. 4). The top surface 22 of the head includes an indentation to define a sight line 24 which is disposed equidistant of the opposite sidewall 26 and 28 of the putter head.

A horizontal axle 30 passes through the center of the head 12 (FIG. 4) and is secured in position by securing means such as, by way of example the tapped hole 32 and the set screw 34. The axle is adapted for rotatably supporting a pair of coaxial wheels 36 and 38. In the preferred embodiment, the wheels include a central hub 40 (see FIG. 5) having a central aperture 42 in which a low friction bearing ring 44 such as a Teflon brand coated ring or the like is mounted. The ring 44 is received on the reduced end 46 of the axle 30. The wheel is then held in position on the axle by placing a mounting screw 48 in the end of the axle, as shown in FIG. 5.

In the preferred embodiment, the outer rim 50 of the wheel includes a resilient covering 52 which is adapted to grip the surface upon which the putter is to be rolled to assure that the putter rolls across the surface without damaging the surface, particularly where fragile grass is encountered, as with well-groomed greens and the like.

The shaft 54 is inserted into the head behind the axle 30, as shown in FIG. 4. The shaft may be secured to the head by any means known to those who are skilled in the art, such as, by plug fitting the shaft 54 into a receptive socket 56, as shown in FIG. 4. In the preferred embodiment, the shaft 54 enters the head 12 at an angle of approximately 60°, permitting the putter to be used from both standing and sitting positions. The shaft is in alignment with the sight line 24 for assisting aiming of the putter relative to the ball and for stroking the putter in the proper direction.

As is shown in FIG. 3, the convex front surface 14 permits the putter to be disposed relative to the ball in any of a number of angular positions, assuring that the strike point 60 between the ball and the putter is always along the horizontal center line 62 of the ball. This facilitates the use of the putter in either a standing or sitting position, and assures that the ball will behave in a predictable manner, regardless of the angular position of the putter, greatly facilitating the use of the putter as a training tool for increasing accuracy and for developing stroke force.

The rear corner or edge 16 of the lower surface 18 of the putter is beveled, to assure that the putter does not drag across the surface, regardless of the angular position of the putter relative to the ball and the putting surface.

While certain features and embodiments of the invention have been described in detail herein, it will be readily understood that the invention encompasses all modifications and enhancements within the scope and spirit of the following claims.

I claim:

1. An improved putter having a shaft adapted to be grasped by the hands of the user and a head attached to the shaft for striking a golf ball, comprising:

a. the head having an upper surface in communication with the shaft and including a sight line extending along the upper surface and outwardly from the shaft;

b. the head having a ball striking surface generally orthogonal to the upper surface and having a convex radius thereon such that the same portion of the ball is contacted independently of the angle of the shaft and head;

c. wheels mounted for rotation on the head on either side of the shaft and on an axis orthogonal to the sight line, whereby the putter may be advanced in the direction of the sight line by pushing the shaft and rolling the head on the wheels.

2. The putter of claim 1, wherein each wheel includes a resilient outer peripheral surface.

3. The putter of claim 1, wherein the wheel axis is between the shaft and the striking surface.

4. The putter of claim 1, wherein the head includes a lower surface which is beveled rearwardly of the wheel axis.

5. The putter of claim 1, wherein the shaft intersects the upper surface of the head at an angle of less than ninety degrees.

6. An improved putter having a shaft adapted to be grasped by the hands of the user and a head attached to the shaft for striking a golf ball, the comprising:

a. the head having an upper surface in communication with the shaft;

b. the head having a ball striking surface generally orthogonal to the upper surface and having a convex radius thereon such that the same portion of the ball is contacted independently of the angle of the shaft and head;

c. wheels mounted for rotation on the head on either side of the shaft, each wheel including a resilient outer peripheral surface, whereby the putter may be advanced in the direction of the shaft extension by pushing the shaft and rolling the head on the wheels.

7. The putter of claim 6, the upper surface of the head further including an sight line extending along the upper surface and outwardly from the shaft.

8. An improved putter having a shaft adapted to be grasped by the hands of the user and a head attached to the shaft for striking a golf ball, comprising:

a. the head having an upper surface in communication with the shaft, the upper surface of the head including a sight line extending along the upper surface and outwardly from the shaft;

b. the head having a ball striking surface generally orthogonal to the upper surface and having a convex radius thereon such that the same portion of the ball is contacted independently of the angle of the shaft and head;

c. wheels mounted for rotation on the head on either side of the shaft and on an axis orthogonal to the sight line, each wheel including a resilient outer peripheral surface, whereby the putter may be advanced in the direction of the sight line by pushing the shaft and rolling the head on the wheels.

9. The putter of claim 8, wherein the wheel axis is between the shaft and the striking surface.

10. The putter of claim 8, wherein the head includes a lower surface which is beveled rearwardly of the wheel axis.

11. The putter of claim 8, wherein the shaft intersects the upper surface of the head at an angle of less than ninety degrees.

* * * * *